US007113133B2

(12) United States Patent
Chen et al.

(10) Patent No.: US 7,113,133 B2
(45) Date of Patent: Sep. 26, 2006

(54) DUAL-BAND INVERTED-F ANTENNA WITH A BRANCH LINE SHORTING STRIP

(75) Inventors: Yi-Shein Chen, Taipei (TW); Tsung-Wen Chiu, Taipei (TW); Ping-Cheng Chang, Taipei (TW); Fu-Ren Hsiao, Taipei (TW)

(73) Assignee: Advanced Connectek Inc., Taipei (TW)

( * ) Notice: Subject to any disclaimer, the term of this patent is extended or adjusted under 35 U.S.C. 154(b) by 0 days.

(21) Appl. No.: 11/113,180

(22) Filed: Apr. 25, 2005

(65) Prior Publication Data

US 2006/0145924 A1 Jul. 6, 2006

(30) Foreign Application Priority Data

Dec. 31, 2004 (TW) ..... 93141573 A

(51) Int. Cl.
*H01Q 1/38* (2006.01)
*H01Q 1/24* (2006.01)

(52) U.S. Cl. ..... 343/700 MS; 343/702; 343/846; 343/770

(58) Field of Classification Search ..... 343/700 MS, 343/702
See application file for complete search history.

(56) References Cited

U.S. PATENT DOCUMENTS

| | | | | |
|---|---|---|---|---|
| 6,552,686 | B1 * | 4/2003 | Ollikainen et al. | 343/700 MS |
| 6,727,854 | B1 | 4/2004 | Fang et al. | 343/700 |
| 6,995,717 | B1 * | 2/2006 | Ryu | 343/702 |
| 2001/0050643 | A1 * | 12/2001 | Egorov et al. | 343/702 |
| 2004/0080457 | A1 * | 4/2004 | Guo et al. | 343/700 MS |

* cited by examiner

*Primary Examiner*—Trinh Vo Dinh
(74) *Attorney, Agent, or Firm*—Troxell Law Office, PLLC

(57) ABSTRACT

Provided is dual-band inverted-F antenna for GSM, DCS, and PCS bands comprising a primary radiating member including integral first and second metallic strips, a feeding point, and a first shorting point wherein a long current path is created in the first strip such that the antenna can operate in a first low frequency operating mode, and a shorting current path is created in the second strip such that the antenna can operate in a second high frequency operating mode; a secondary radiating member comprising a second shorting point; a branch line shorting strip having one grounded end and a bifurcation including a first branch connected to the first shorting point and a second branch connected to the second shorting point; and a feeding member interconnected the feeding point and a signal source. Operating frequencies of the antenna are 90 MHz and 300 MHz respectively when it operates in 3.5:1 VSWR impedance bandwidth.

10 Claims, 3 Drawing Sheets

DUAL-BAND INVERTED-F ANTENNA WITH A BRANCH LINE SHORTING STRIP

BACKGROUND OF THE INVENTION

1. Field of Invention

The present invention relates to inverted-F antennas and more particularly to a dual-band inverted-F antenna with a branch line shorting strip mounted in a wireless communication device (e.g., cellular phone, PDA, etc.).

2. Description of Related Art

Wireless communication has known a rapid, spectacular development in recent years. Also, requirements for quality and performance of antenna mounted in a wireless communication device (e.g., cellular phone, PDA) are increased. In addition to the requirement of miniature antenna, multiple frequency band or ultra-wideband feature is also necessary for keeping up with the trend. Moreover, for aesthetic and practical purposes a miniature antenna is typically mounted within a wireless communication device (e.g., cellular phone). However, construction of the antenna can be very complicated for meeting the above requirements and needs. Thus, it is important to further improve the prior hidden antenna by fully taking advantage of the limited space in a wireless communication device (e.g., cellular phone or PDA).

Typically, a wireless communication device (e.g., cellular phone or PDA) is equipped with an inverted-F antenna therein. For example, U.S. Pat. No. 6,727,854 discloses a planar inverted-F antenna mounted in a cellular phone in FIG. 1. The antenna comprises a radiating device including left and right radiating elements (e.g., metallic strips) and an intermediate radiating elements (e.g., metallic patch) in which a feeding point 15 is formed at one end of the left radiating element, a shorting point 16 is formed at one end of the right radiating element opposing the feeding point 15, and three surface current pathways 10, 13, and 14 are formed in the intermediate, left, and right radiating elements respectively. Two different resonance frequencies are generated by these surface current pathways such that the antenna is able to operate in a GSM band or DCS band (i.e., dual-band capability).

However, the prior art suffered from several disadvantages. For example, only a single shorting line is provided. Further, its construction is relatively complicated. Furthermore, the surface current pathways are meandered, resulting in a narrowing of bandwidth (i.e., only suitable for dual-band applications). Moreover, its adjustment is difficult in practice. Thus, the need for improvement still exists in order to overcome the inadequacies of the prior art.

SUMMARY OF THE INVENTION

It is therefore an object of the present invention to provide a dual-band inverted-F antenna comprising a primary radiating member comprising a first metallic strip, a second metallic strip integrally formed with the first metallic strip, a feeding point on the second metallic strip, and a first shorting point on the second metallic strip wherein a first current path is created in the first metallic strip such that the antenna is adapted to operate in a first low frequency operating mode, and a second current path shorter than the first current path is created in the second metallic strip such that the antenna is adapted to operate in a second high frequency operating mode; a secondary radiating member for increasing an operating frequency of the antenna when the antenna operates in the second high frequency operating mode, the secondary radiating member comprising a second shorting point; a ground surface; a dielectric substrate; a branch line shorting strip having one end electrically connected to the ground surface, and a bifurcation distal its one end, the bifurcation including a first branch electrically connected to the first shorting point and a second branch electrically connected to the second shorting point; and a feeding member formed of a metallic strip having one end electrically connected to the feeding point and the other end electrically connected to a system signal source for sending and receiving electromagnetic waves. A dual-band inverted-F antenna having above construction is able to operate in multiple frequency band mode or ultra-wideband mode.

In one aspect of the present invention an electromagnetic coupling mode is created in the secondary radiating member, the electromagnetic coupling mode and the second high frequency operating mode can be combined as a broadband operating mode by adjusting length and width of the secondary radiating member, an operating frequency of the antenna is increased when it operates in the second high frequency operating mode, the first and second branches are adapted to adjust input impedance of the primary radiating member and the secondary radiating member, and a desired input impedance of the antenna operating mode can be obtained by adjusting lengths and widths of the branches.

In another aspect of the present invention operating frequencies of the antenna are 90 MHz and 300 MHz respectively when the antenna operates in 3.5:1 VSWR impedance bandwidth, and the antenna is sufficient to meet the bandwidth requirements of GSM band, DCS band, and PCS band in mobile communication applications.

The above and other objects, features and advantages of the present invention will become apparent from the following detailed description taken with the accompanying drawings.

DETAILED DESCRIPTION OF THE INVENTION

Figure 1:
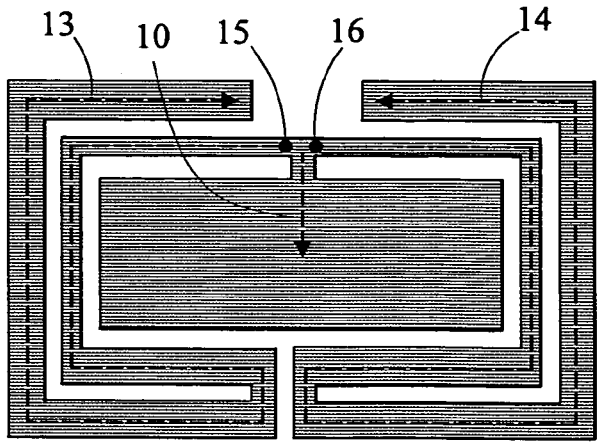
FIG. 1(prior art)
FIG. 1 is a top plane view of a conventional planar inverted-F antenna.
Figure 2:
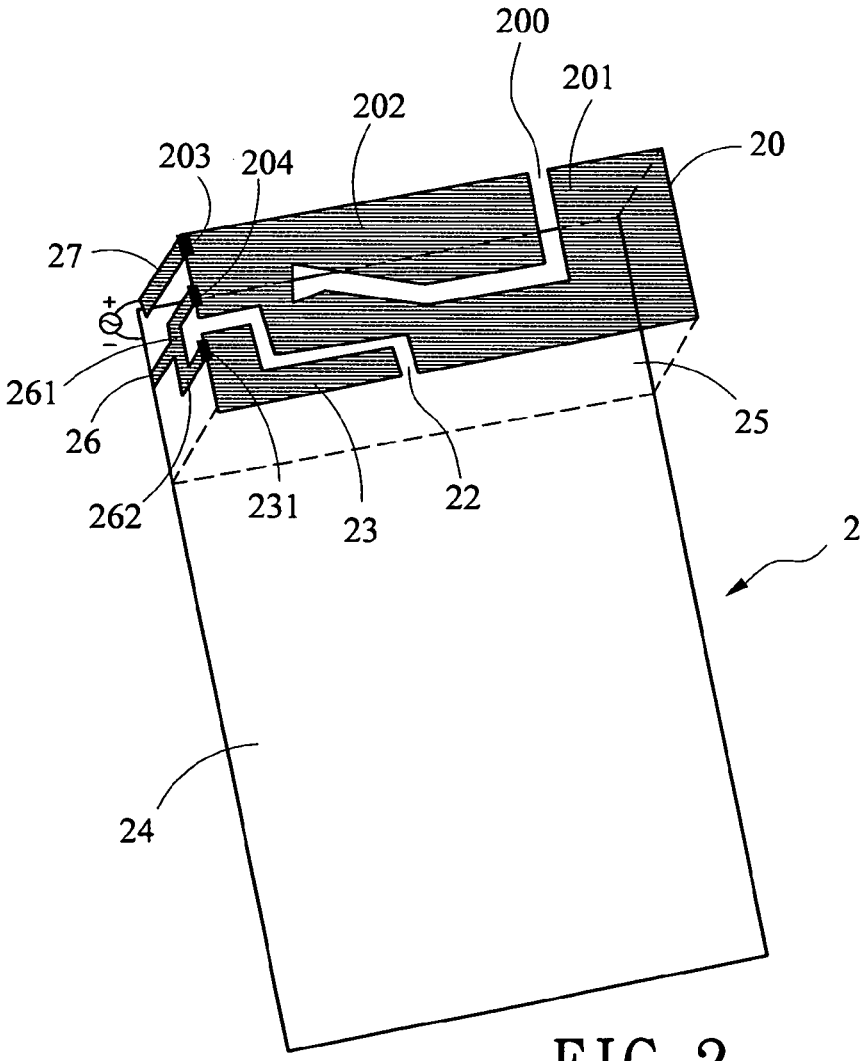
FIG. 2 is a schematic perspective view of a first preferred embodiment of dual-band inverted-F antenna according to the invention.

Referring to FIG. 2, there is shown a dual-band inverted-F antenna 2 in accordance with a first preferred embodiment of the invention comprising a primary radiating member 20, a secondary radiating member 23, a ground surface 24, a dielectric substrate 25, a branch line shorting strip 26, and a feeding member 27. Each component is discussed in detailed below.

The primary radiating member 20 comprises a first metallic strip 201, a resembled L-shaped slot 200 formed between the first metallic strip 201 and the second metallic strip 202, a second metallic strip 202 integrally formed with the first metallic strip 201, a feeding point 203 at an edge of the second metallic strip 202, and a first shorting point 204 at the edge of the second metallic strip 202 adjacent the feeding point 203. A long current path is created in the first metallic strip 201 such that the antenna can operate in a first low frequency operating mode. A shorting current path is created in the second metallic strip 202 such that the antenna can operate in a second high frequency operating mode. A double connected inverted L-shaped slot 22 is disposed between the primary radiating member 20 and the second radiating member 23. An electromagnetic coupling mode is created in the secondary radiating member 23 such that the electromagnetic coupling mode and the second high frequency operating mode can be combined as a broadband operating mode by adjusting length and width of the secondary radiating member 23. As a result, an operating frequency of the antenna is increased when it operates in the second high frequency operating mode. The secondary radiating member 23 comprises a second shorting point 231 at an edge thereof proximate the first shorting point 204. The branch line shorting strip 26 has one end electrically connected to the ground surface 24 (i.e., grounded), and a bifurcation distal one end formed on one side surface of the substrate 25, the bifurcation having a first branch 261 electrically connected to the first shorting point 204 and a second branch 262 electrically connected to the second shorting point 231. The first and second branches 261 and 262 are adapted to adjust input impedance of the primary radiating member 20 and the secondary radiating member 23. That is, a desired input impedance of the antenna operating mode can be obtained by adjusting lengths and widths of the branches 261 and 262. The feeding member 27 formed of a metallic strip has one end electrically connected to the feeding point 203 and the other end electrically connected to a system signal source for sending and receiving electromagnetic waves.

Figure 3:
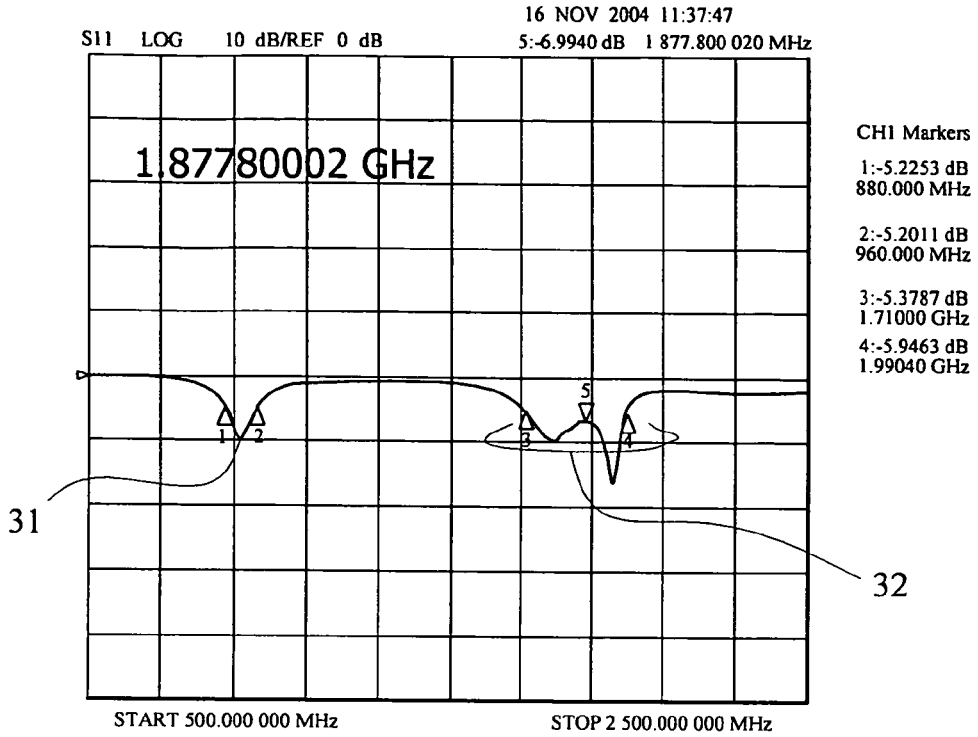
FIG. 3 is a graph illustrating return loss of the antenna in FIG. 2.

Referring to FIG. 3, this graph illustrates return loss of the antenna of the invention in which curve 31 represents return loss of the antenna operating in the first low frequency operating mode and curve 32 represents return loss of the antenna operating in the second high frequency operating mode. Operating frequencies of the antenna are 90 MHz and 300 MHz respectively when the antenna operates in 3.5:1 VSWR (voltage standing wave ratio) impedance bandwidth. It is clear that the antenna of the invention is sufficient to meet the bandwidth requirements of GSM band (880~960 MHz), DCS band (1710~1880 MHz), and PCS band (1850~1990 MHz) in mobile communication applications.

Figure 4:
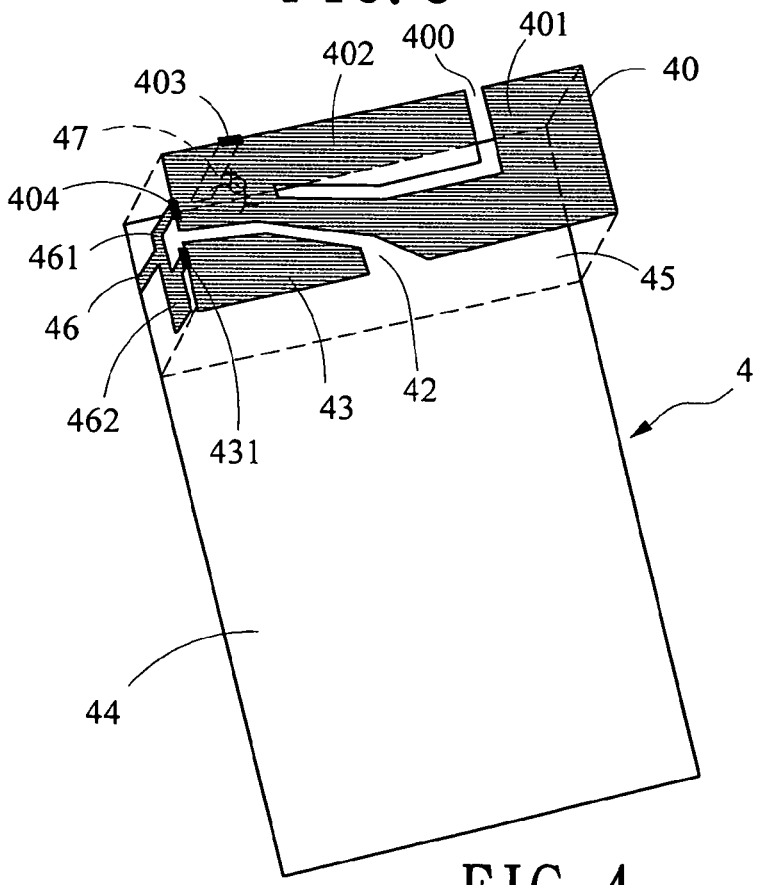
FIG. 4 is a schematic perspective view of a second preferred embodiment of dual-band inverted-F antenna according to the invention.

Referring to FIG. 4, it shows a second preferred embodiment of dual-band inverted-F antenna 4 according to the invention. The second preferred embodiment substantially has same construction as the first preferred embodiment. The characteristics of the second preferred embodiment are detailed below. The dual-band inverted-F antenna 4 comprises a primary radiating member 40, a secondary radiating member 43, a ground surface 44, a dielectric substrate 45, a branch line shorting strip 46, and a feeding member 47. Each component is discussed in detailed below.

The primary radiating member 40 comprises a first metallic strip 401, a second metallic strip 402 integrally formed with the first metallic strip 401, a resembled L-shaped slot 400 formed between the first metallic strip 401 and the second metallic strip 402, a feeding point 403 at one edge of the second metallic strip 402, and a first shorting point 404 at the other edge of the second metallic strip 402. A long current path is created in the first metallic strip 401 such that the antenna can operate in a first low frequency operating mode. A shorting current path is created in the second metallic strip 402 such that the antenna can operate in a second high frequency operating mode. A reversed long V-shaped slot 42 is disposed between the primary radiating member 40 and the second radiating member 43. An electromagnetic coupling mode is created in the secondary radiating member 43 such that the electromagnetic coupling mode and the second high frequency operating mode can be combined as a broadband operating mode by adjusting length and width of the secondary radiating member 43. As a result, an operating frequency of the antenna is increased when it operates in the second high frequency operating mode. The secondary radiating member 43 comprises a second shorting point 431 at an edge thereof proximate the first shorting point 404. The branch line shorting strip 46 has one end electrically connected to the ground surface 44 (i.e., grounded), and a bifurcation distal one end formed on one side surface of the substrate 45, the bifurcation having a first branch 461 electrically connected to the first shorting point 404 and a second branch 462 electrically connected to the second shorting point 431. The first and second branches 461 and 462 are adapted to adjust input impedance of the primary radiating member 40 and the secondary radiating member 43. That is, a desired input impedance of the antenna operating mode can be obtained by adjusting lengths and widths of the branches 461 and 462. The feeding member 47 formed of a metallic strip has one end electrically connected to the feeding point 403 and the other end electrically connected to a system signal source for sending and receiving electromagnetic waves. In brief, the differences between the first and the second preferred embodiments are location of the feeding point 403 and shapes of the slot 42, the second branch 462 and the secondary radiating member 43.

Figure 5:
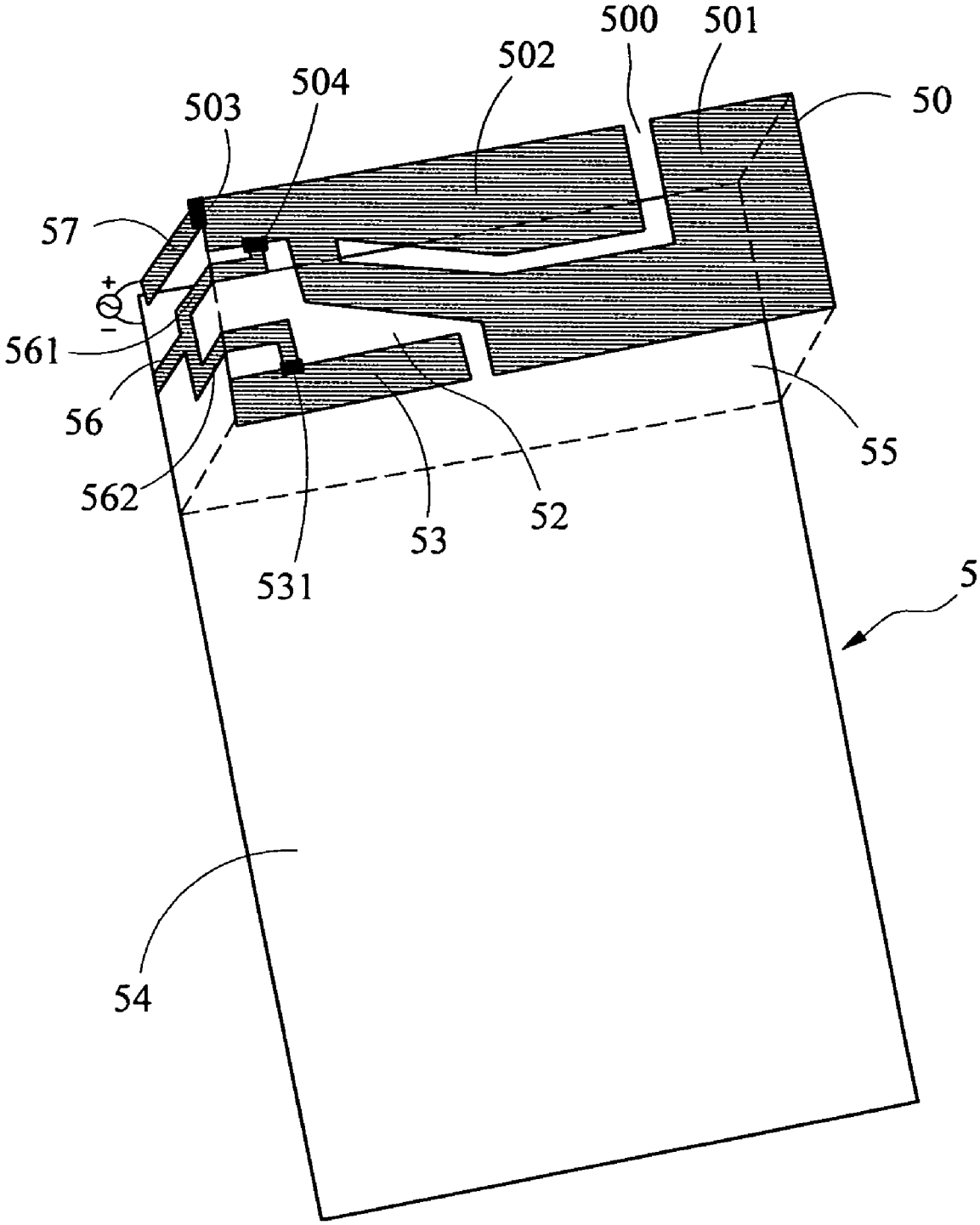
FIG. 5 is a schematic perspective view of a third preferred embodiment of dual-band inverted-F antenna according to the invention.

Referring to FIG. 5, it shows a third preferred embodiment of dual-band inverted-F antenna 5 according to the invention. The third preferred embodiment substantially has same construction as the first preferred embodiment. The characteristics of the third preferred embodiment are detailed below. The dual-band inverted-F antenna 5 comprises a primary radiating member 50, a secondary radiating member 53, a ground surface 54, a dielectric substrate 55, a branch line shorting strip 56, and a feeding member 57. Each component is discussed in detailed below.

The primary radiating member 50 comprises a first metallic strip 501, a second metallic strip 502 integrally formed with the first metallic strip 501, a resembled L-shaped slot 500 formed between the first metallic strip 501 and the second metallic strip 502, a feeding point 503 at one edge of the second metallic strip 502, and a first shorting point 504 within the primary radiating member 50. A long current path is created in the first metallic strip 501 such that the antenna can operate in a first low frequency operating mode. A shorting current path is created in the second metallic strip 502 such that the antenna can operate in a second high frequency operating mode. A large open mouth Y-shaped opening 52 is formed between the primary radiating member 50 and the second radiating member 53. An electromagnetic coupling mode is created in the secondary radiating member 53 such that the electromagnetic coupling mode and the second high frequency operating mode can be combined as a broadband operating mode by adjusting length and width of the secondary radiating member 53. As a result, an operating frequency of the antenna is increased when it operates in the second high frequency operating mode. The secondary radiating member 53 comprises a second shorting point 531 at an edge thereof proximate the first shorting point 504. The branch line shorting strip 56 has one end electrically connected to the ground surface 54 (i.e., grounded), and a bifurcation distal one end formed across two adjacent surfaces of the substrate 55, the bifurcation having a first branch 561 electrically connected to the first shorting point 504 and a second branch 562 electrically connected to the second shorting point 531. The first and second branches 561 and 562 are adapted to adjust input impedance of the primary radiating member 50 and the secondary radiating member 53. That is, a desired input impedance of the antenna operating mode can be obtained by adjusting lengths and widths of the branches 561 and 562. The feeding member 57 formed of a metallic strip has one end electrically connected to the feeding point 503 and the other end electrically connected to a system signal source for sending and receiving electromagnetic waves. In brief, the differences between the first and the third preferred embodiments are location of the first shorting point 504 (i.e., extending within the primary radiating member 50), location of the second shorting point 531, and shape of the opening 52 and the secondary radiating member 53.

While the invention herein disclosed has been described by means of specific embodiments, numerous modifications and variations could be made thereto by those skilled in the art without departing from the scope and spirit of the invention set forth in the claims.

What is claimed is:

1. A dual-band inverted-F antenna comprising:

a primary radiating member comprising a first metallic strip, a second metallic strip integrally formed with the first metallic strip, a feeding point on the second metallic strip, and a first shorting point on the second metallic strip wherein a first current path is created in the first metallic strip such that the antenna is adapted to operate in a first low frequency operating mode, and a second current path shorter than the first current path is created in the second metallic strip such that the antenna is adapted to operate in a second high frequency operating mode;

a secondary radiating member for increasing an operating frequency of the antenna when the antenna operates in the second high frequency operating mode, the secondary radiating member comprising a second shorting point;

a ground surface;

a dielectric substrate;

a branch line shorting strip having one end electrically connected to the ground surface, and a bifurcation distal its one end, the bifurcation including a first branch electrically connected to the first shorting point and a second branch electrically connected to the second shorting point; and a feeding member formed of a metallic strip having one end electrically connected to the feeding point and the other end electrically connected to a system signal source for sending and receiving electromagnetic waves.

2. The dual-band inverted-F antenna of claim 1, wherein the feeding point and the first shorting point are located at the same edge of the primary radiating member.

3. The dual-band inverted-F antenna of claim 1, wherein the feeding point and the first shorting point are located at two different edges of the primary radiating member.

4. The dual-band inverted-F antenna of claim 1, wherein the first shorting point and the second shorting point are located within the primary radiating member.

5. The dual-band inverted-F antenna of claim 1, wherein the bifurcation is formed on one surface of the substrate.

6. The dual-band inverted-F antenna of claim 1, wherein the bifurcation is formed across two adjacent surfaces of the substrate.

7. The dual-band inverted-F antenna of claim 1, wherein a double reverted L-shaped slot is formed between the primary radiating member and the second radiating member.

8. The dual-band inverted-F antenna of claim 1, wherein a reverted long V-shaped slot is formed between the primary radiating member and the second radiating member.

9. The dual-band inverted-F antenna of claim 1, wherein a large open mouth Y-shaped opening is formed between the primary radiating member and the second radiating member.

10. The dual-band inverted-F antenna of claim 1, wherein a resembled L-shaped slot is formed between the first metallic strip and the second metallic strip.

* * * * *